US011385018B2

(12) United States Patent
Willits

(10) Patent No.: US 11,385,018 B2
(45) Date of Patent: Jul. 12, 2022

(54) PISTOL GRIP ASSEMBLY

(71) Applicant: F-1 Research, LLC—Patent Series, Spring, TX (US)

(72) Inventor: Craig Larue Willits, Spring, TX (US)

(73) Assignee: F-1 Research LLC—Patent Series, Spring, TX (US)

( * ) Notice: Subject to any disclaimer, the term of this patent is extended or adjusted under 35 U.S.C. 154(b) by 0 days.

(21) Appl. No.: 16/057,233

(22) Filed: Aug. 7, 2018

(65) Prior Publication Data

US 2020/0049450 A1 Feb. 13, 2020

(51) Int. Cl.
*F41C 23/10* (2006.01)
*F41C 23/14* (2006.01)
*F41A 3/66* (2006.01)

(52) U.S. Cl.
CPC ..... *F41C 23/14* (2013.01); *F41A 3/66* (2013.01); *F41C 23/10* (2013.01)

(58) Field of Classification Search
CPC ..... F41C 23/14; F41C 23/10; F41C 27/00; F41A 35/06
USPC ..... 42/71.02
See application file for complete search history.

(56) References Cited

U.S. PATENT DOCUMENTS 1,410,266 A * 3/1922 Pedersen ..... F41C 23/10 42/7
1,940,362 A * 12/1933 Mcclarin, Sr. ..... F41C 23/10 42/71.02
1,962,775 A * 6/1934 Jones ..... F41C 23/10 42/71.02
RE20,456 E * 7/1937 McClarin, Sr. ..... F41C 23/10 42/71.02
D142,016 S * 8/1945 Birk ..... D22/104
2,903,810 A * 9/1959 Lewis ..... F41C 23/10 42/71.02
2,903,811 A * 9/1959 Freed ..... F41C 23/10 42/74
3,685,194 A * 8/1972 Coon ..... F41C 23/12 42/77
3,815,270 A * 6/1974 Pachmayr ..... F41C 23/10 42/71.02
4,132,024 A * 1/1979 Pachmayr ..... F41C 23/10 42/71.02
4,221,066 A * 9/1980 Hillberg ..... F41C 23/10 42/71.02
4,315,379 A * 2/1982 Lang ..... F41C 23/10 42/71.02
4,658,528 A * 4/1987 Ruger ..... F41C 23/10 42/71.02
4,771,562 A * 9/1988 Ruger ..... F41C 23/10 42/71.02
4,999,941 A * 3/1991 Farrar ..... F41C 23/10 42/71.02

(Continued)

*Primary Examiner* — Joshua E Freeman
(74) *Attorney, Agent, or Firm* — Phillip Black; Dossey & Jones PLLC

(57) ABSTRACT

A pistol grip assembly having customizable accessories are disclosed here. The pistol grip assembly can include a handle, a first accessory removably attached to the left side of the handle, and a second accessory removably attached to the right side of the handle. A frame can be disposed in a central cut-out of the handle and the first and second accessories can be removably attached to the frame. The pistol grip assembly can also include a thumb rest and a trigger finger rest.

5 Claims, 7 Drawing Sheets

(56) References Cited

U.S. PATENT DOCUMENTS 5,166,459 A * 11/1992 Stahle ..... F41C 27/00 42/111
D335,520 S * 5/1993 Capone ..... F41C 23/10 D22/108
5,231,237 A * 7/1993 Cupp ..... F41C 23/10 42/71.02
5,465,520 A * 11/1995 Cupp ..... F41C 23/10 42/71.02
5,560,136 A * 10/1996 Cupp ..... F41C 23/10 42/71.02
5,621,997 A * 4/1997 Pearce ..... F41C 23/10 42/7
6,073,381 A * 6/2000 Farrar ..... F41C 23/10 42/71.02
6,804,907 B1 * 10/2004 Slobodkin ..... F41C 23/14 42/71.01
6,964,123 B2 * 11/2005 Vicale ..... F41C 3/00 42/106
6,981,344 B2 * 1/2006 Cahill ..... F41C 23/10 42/71.01
7,287,455 B2 * 10/2007 Key-Carniak ..... F41C 23/10 89/36.01
D664,234 S * 7/2012 Nierenberg ..... D22/108
8,490,311 B2 * 7/2013 Hogue ..... F41C 23/10 42/71.01
8,584,390 B1 * 11/2013 Fraher ..... F41C 23/10 42/71.02
8,720,098 B2 * 5/2014 Burress, Jr. ..... F41C 23/10 42/71.01
D735,832 S * 8/2015 Fitzpatrick ..... D22/108
D740,910 S * 10/2015 Hines ..... D22/108
9,777,977 B1 * 10/2017 Makaron ..... F41A 3/72
9,777,984 B1 * 10/2017 Bonine ..... F41C 23/10
D812,181 S * 3/2018 Hartley ..... D22/109
D812,708 S * 3/2018 Hartley ..... D22/109
9,909,830 B1 * 3/2018 Toole ..... F41A 35/02
D821,529 S * 6/2018 Cheng ..... D22/108
10,054,391 B1 * 8/2018 Lyman ..... F41C 3/00
10,054,392 B2 * 8/2018 Maroney ..... F41C 23/10
10,156,423 B2 * 12/2018 Bruhns ..... F41C 23/10
D849,177 S * 5/2019 Willits ..... D22/108
10,371,365 B2 * 8/2019 Moore ..... F41G 1/36
D861,116 S * 9/2019 Willits ..... F41C 23/10 D22/108
D898,153 S * 10/2020 Podgurny ..... F41C 23/16 D22/108
2002/0047029 A1 * 4/2002 Liao ..... F41C 33/041 224/244
2010/0132238 A1 * 6/2010 Werner ..... F41C 23/10 42/71.02
2010/0139144 A1 * 6/2010 Fitzpatrick ..... F41A 11/02 42/73
2010/0212202 A1 * 8/2010 Roth ..... F41C 23/10 42/71.01
2010/0263254 A1 * 10/2010 Glock ..... F41A 11/02 42/71.02
2011/0225862 A1 * 9/2011 Lowry ..... F41A 5/16 42/6
2013/0205635 A1 * 8/2013 Hines ..... F41C 23/16 42/71.02
2015/0047244 A1 * 2/2015 Tusting ..... F41C 23/04 42/71.02
2016/0010945 A9 * 1/2016 Ermossa ..... F41C 23/10 42/69.01
2016/0202018 A1 * 7/2016 Bruhns ..... F41C 23/22 42/71.01
2017/0108301 A1 * 4/2017 Murphy, II ..... F41A 17/20
2020/0049449 A1 * 2/2020 Haase ..... F41C 23/10
2020/0049450 A1 * 2/2020 Willits ..... F41A 3/66

* cited by examiner

PISTOL GRIP ASSEMBLY

BACKGROUND OF INVENTION

Field of the Invention

This invention relates to the general field of a handle for a firearm. More particularly, this invention relates to a pistol grip handle for a firearm having interchangeable inserts.

Description of Related Art

The firearm industry continued to develop products to suite consumer preferences. More recently, products are being developed to provide better accuracy, to accommodate both aesthetic and style trends in the market, and to provide a better overall utility for the user. Customization of firearm products, including military style rifles, has become exceedingly popular, as users are looking to add a "personal touch" to their firearm. For example, a user can have the exterior surface of his/her rifle components (upper receiver, lower receiver, pistol grip, handguard, stock, and barrel) painted, coated, or texturized.

Pistol grip handles are typically produced at a standard size, but recently, manufacturers have provided different shapes and sized to fit a user's preferred grip. In currently manufactured pistol grips, once purchased the size and shape of the pistol grip cannot be changed. Rather, another pistol grip, meeting the user's new needs or preferences, must be purchased. A need exists, therefore, for a pistol grip capable of both cosmetic, aesthetic, and structural customizability.

SUMMARY OF THE INVENTION

Once aspect of the disclosed pistol grip assembly is to provide a means by which a user can interchange components to meet cosmetic, aesthetic, and structural needs. More particularly, the pistol grip can include a handle having a cut-out and a frame member configured to fit into the cut-out. One or more accessory pieces can be attached to the left and right side of the frame member. The accessory pieces are completely customizable. More specifically, the width, shape, size, color, texture, composition, and coating of each accessory can be modified to meet the user's needs and desires. The term "pistol grip" as used herein is commonly used in the industry to mean the handle disposed on a firearm near the trigger and is most often held by the shooter's firing/trigger hand; the term is not limited to "pistol" style firearms.

BRIEF DESCRIPTION OF THE SEVERAL VIEWS OF THE DRAWINGS

The accompanying drawings illustrate various exemplary implementations and are part of the specification. The illustrated implementations are proffered for purpose of example, not for purpose of limitation.

DETAILED DESCRIPTION OF THE INVENTION

Figure 1:
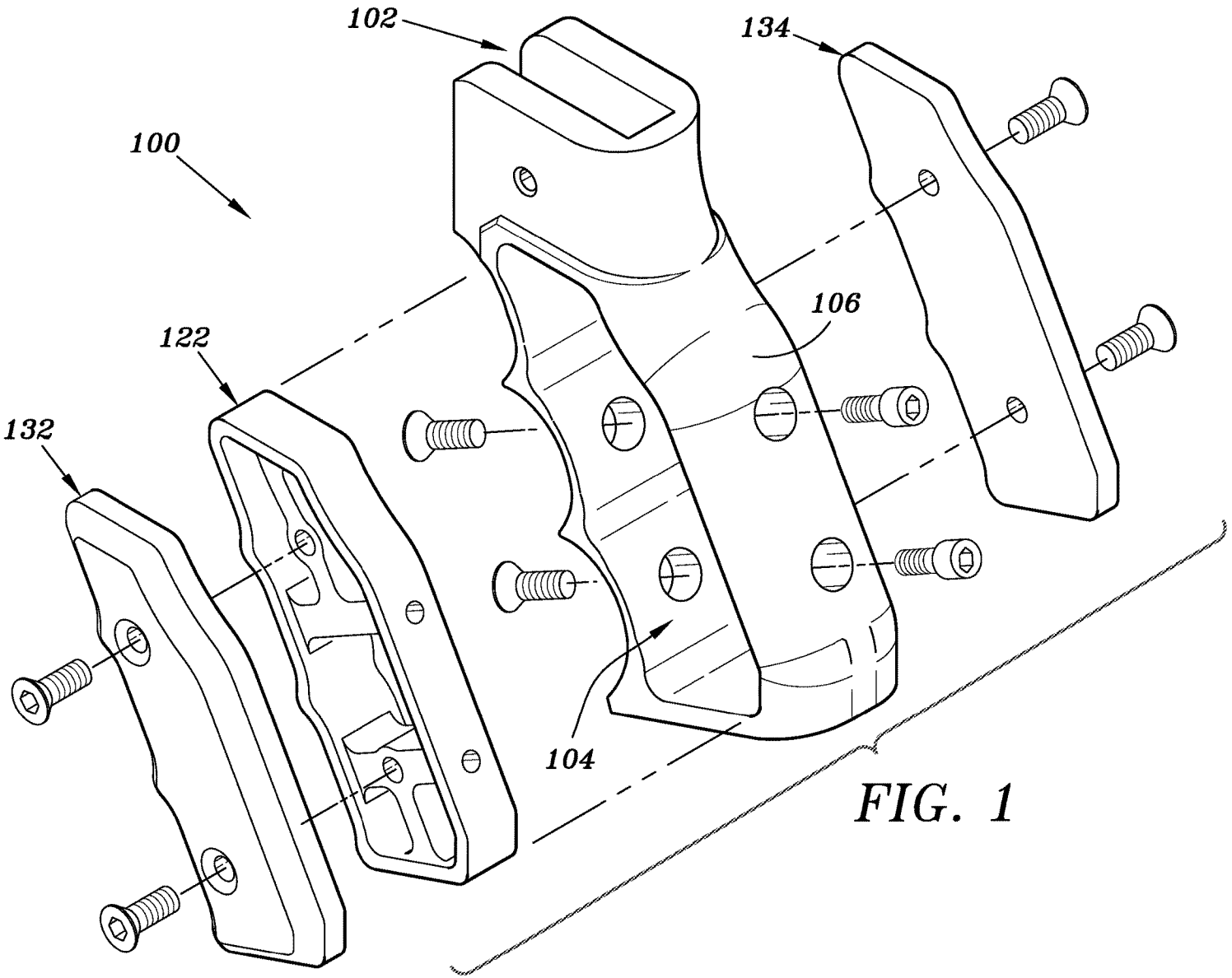
FIG. 1 depicts an exploded view of the pistol grip assembly, as shown and described herein.

The pistol grip assembly, also referred to herein as "pistol grip," will be more fully understood and appreciated by reading the following Detailed Description in conjunction with the accompanying drawings, wherein like reference numerals refer to like components.

FIG. 1 depicts an exploded rear view of the pistol grip assembly 100. The pistol grip assembly 100 can include a handle 102, a frame 122, and one or more accessories (two accessories are shown, a left accessory 132 and a right accessory 134). A cut-out 104 in the handle 102 can be configured to house the frame 122 and, in most embodiments, at least a portion of each accessory 132, 134. One or more connectors/fasteners can be used to secure the frame 122 in the hand 102 and the accessories 132, 134 to the frame 122. For example, one or more screws can be disposed through the palm rest 106 of the handle and connected to the frame 122 when disposed therein.

The pistol grip assembly can be configured to attach to a firearm and provide a gripping surface for the shooter (or "user") of that firearm to grip the firearm. In most embodiments, the pistol grip assembly 100 is attached to the lower receiver of a rifle at or near the trigger and provides a right-hand grip for a right-handed shooter and a left-hand grip for a left-handed shooter. The improvements to a pistol grip presented herein are made to provide, at least in part, an overall improvement to the firearm on which the disclosed pistol grip assembly is attached during use of the firearm.

Figure 2A:
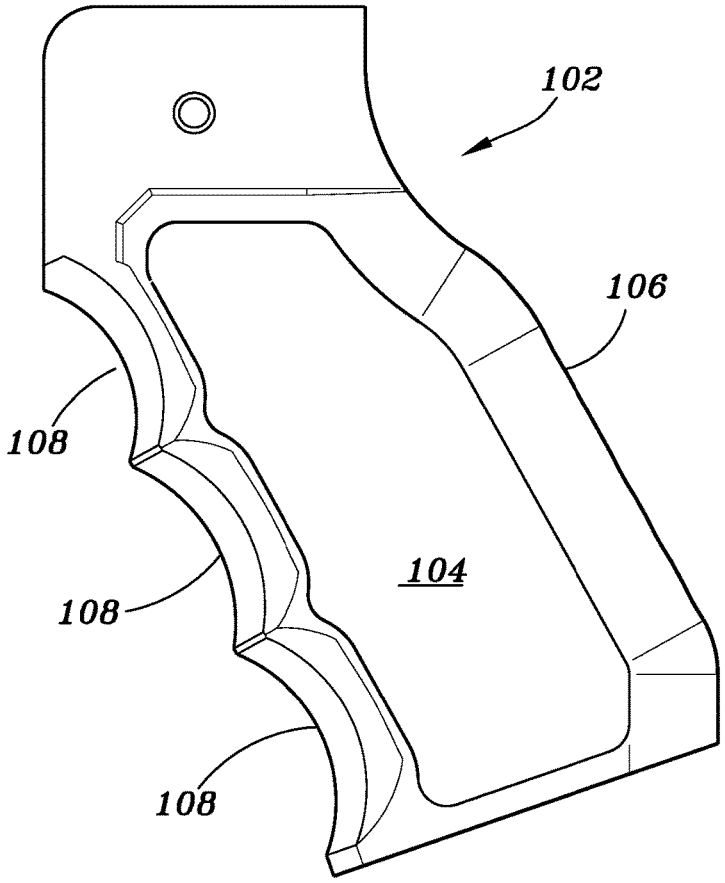
FIG. 2*a* depicts a left-side view of the handle, as shown and described herein.
Figure 2B:
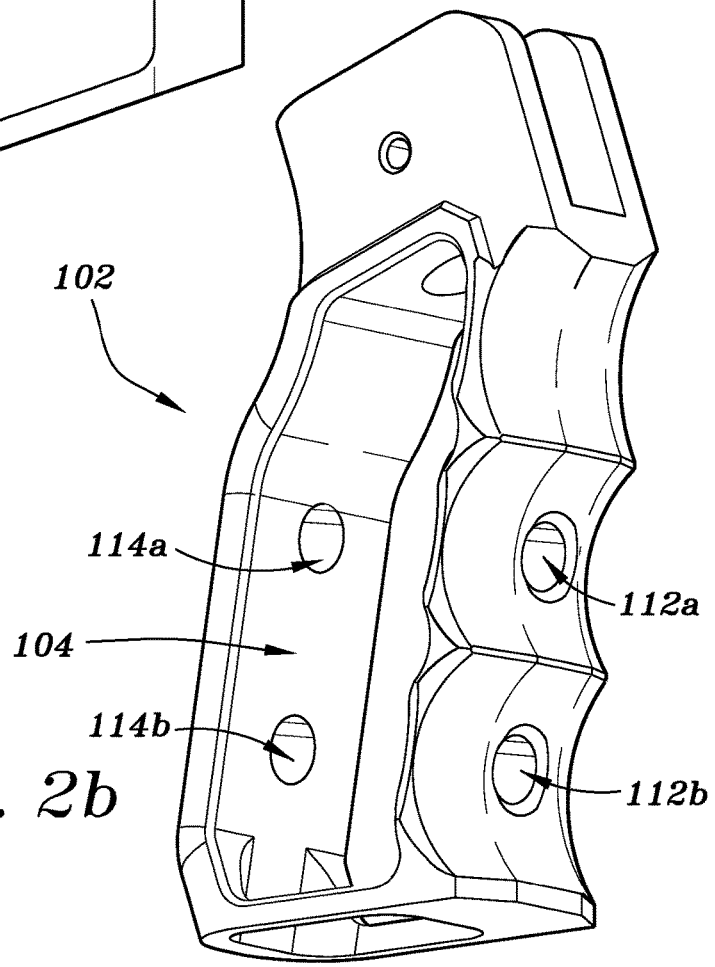
FIG. 2*b* depicts a front perspective view of the right side of the handle, as shown and described herein.
Figure 2C:
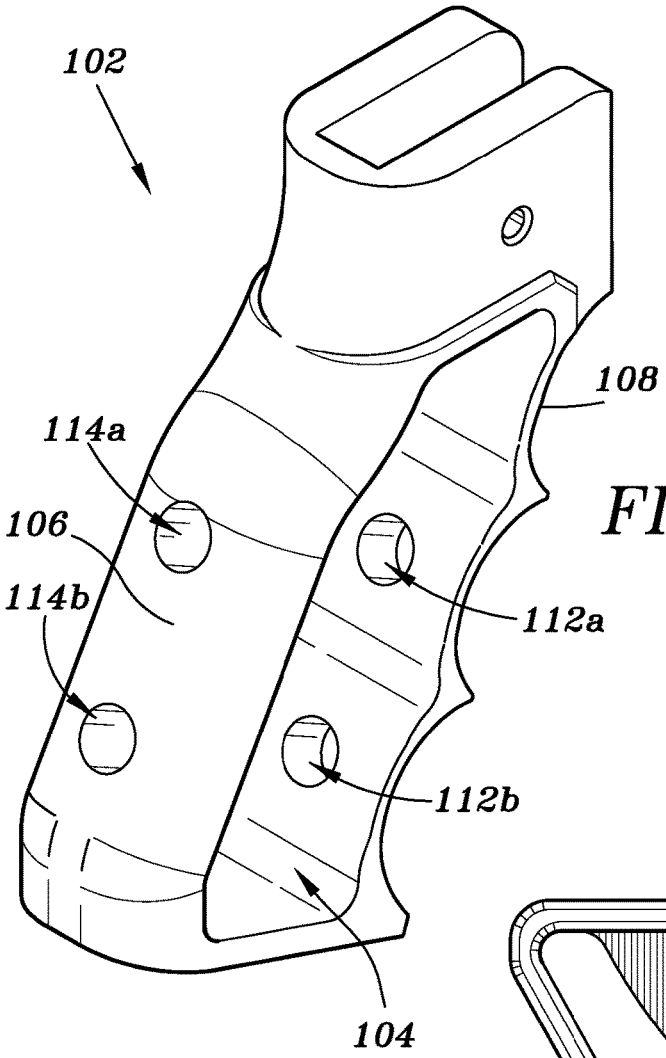
FIG. 2*c* depicts a rear perspective view of the right side of the handle, as shown and described herein.

FIG. 2*a* depicts a left-side view of the handle, FIG. 2*b* depicts a front perspective view of the fight side of the handle, and FIG. 2*c* depicts a rear perspective view of the right side of the handle. The handle 102 can include one or more finger rests 108 (three are shown) on or about the front side of the handle 102 and a palm rest 106 about the back side of the handle 102. In common use, the user can grip the handle by placing each of his third (or "middle"), fourth (or "ring"), and fifth (or "pinky") fingers in a corresponding finger rest 108. The handle is sized such that, as the user takes a firm grip of the handle 102, his palm engages the palm rest 106 about the back side of the handle 102. As shown, the handle 102 can include one or more through-holes 112*a-b*, 114*a-b* so that one or more connectors/fasteners (i.e., bolt, screw, etc.) can be disposed through the wall of the handle 102 and secure the frame 122 and/or accessories 132, 134 to the handle 102.

A cut-out 104 can be made about the middle of the handle 102 and extend from about the top portion of the handle to about the bottom portion of the handle 102, as shown in the figures. The handle cut-out 104 can also extend from about the front side of the handle 102 to about the back side of the handle 102. The handle cut-out 104 can extend completely through the handle 102 from the left side to the right side, leaving a channel or void. The handle cut-out 104 can generally be any shape or size, however, a preferred embodiment can include the cut-out 104 having a length and width compatible with the frame 122, as discussed below.

Figure 3A:
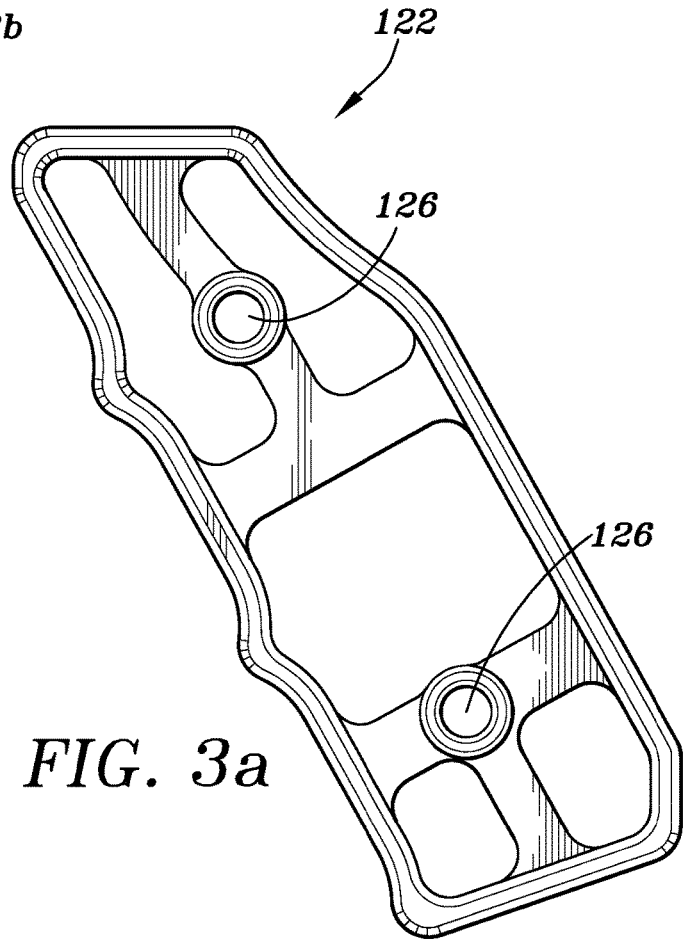
FIG. 3*a* depicts a left-side view of the frame, as shown and described herein.
Figure 3B:
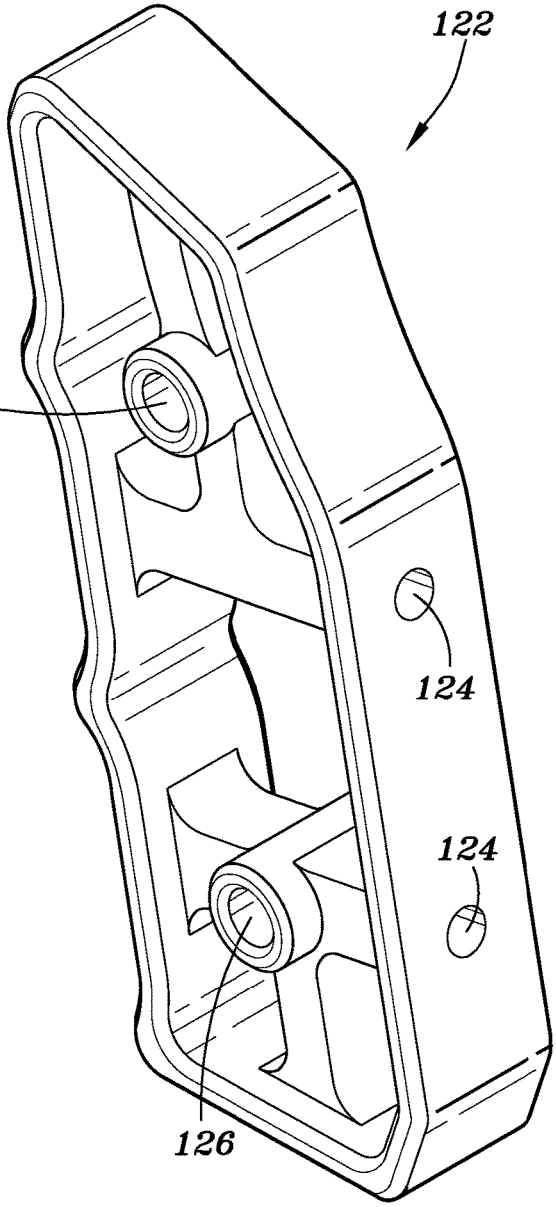
FIG. 3*b* depicts a rear perspective view of the left side of the frame, as shown and described herein.
Figure 3C:
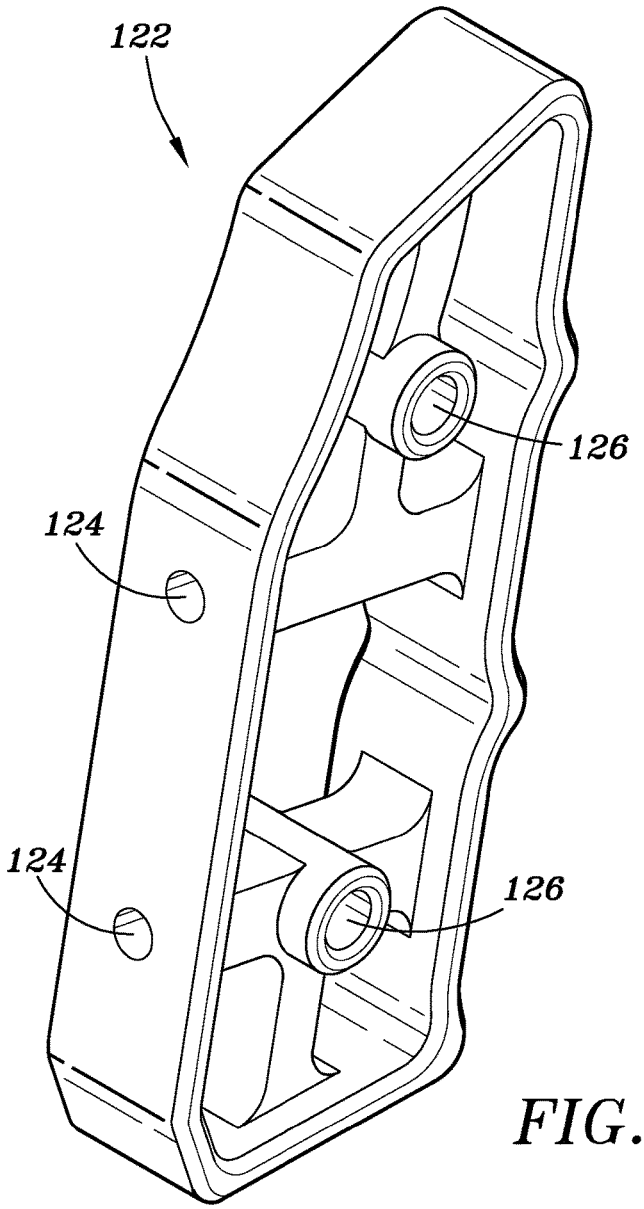
FIG. 3*c* depicts a rear perspective view of the right side of the frame, as shown and described herein.

FIG. 3*a* depicts a left-side view of the frame 122, FIG. 3*b* depicts a rear perspective view of the left side of the frame 122, and FIG. 3*c* depicts a rear perspective view of the right side of the frame 122. The exterior surface of the frame 122 can have a shape and size compatible with the handle cut-out 104 so that the frame 104 can be disposed and secured within the cut-out 104, and as shown, can include a threaded receiver for a bolt or screw. As shown, the frame 122 can have an exterior shape matching the shape of the handle cut-out 104 so that the frame 122 can slide into and/or fit comfortably within the handle cut-out 104.

The frame 122 can include one or more handle anchors 124 (two are shown). The handle anchors 124 are configured to secure the frame within the cut-out 104 of the handle 102. The frame 122 can include an exterior wall about its top side, bottom side, front side, and back side. The exterior wall gives the frame 122 its shape. As shown herein, the shape of the frame 122 is generally configured and designed to correspond with the internal surface of the handle cut-out 104. The frame 122 can also include one or more internal support walls. The internal support walls can provide structural support for the frame 122 and can provide positioning for the accessory anchors 126. The accessory anchors 126 can be configured to receive connectors/fasteners (i.e., bolts, screws, etc.) for securing the accessories to the frame. In one or more embodiments, the handle anchors 124 and accessory anchors 126 can include threaded holes configures to receive a bolt or screw.

In an alternative embodiment (not shown), the handle cut-out 104 can include a shallow cut-out on each of the left and right sides of the handle 102. In such an embodiment, the frame 122 can be extended through a smaller void or hole that extends from the left cut-out to the right cut-out, linking the two sides. As such, the accessory may or may not reflect the general outline shape of the frame, and in some cases, can differ in shape entirely.

In another alternative embodiment (not shown), the frame can be absent from the pistol grip assembly. In such embodiment, the left and right accessories may connect to one another in the middle of the cut-out. The accessories can then be secured within the handle by one or more suitable attachment means.

Figure 4:
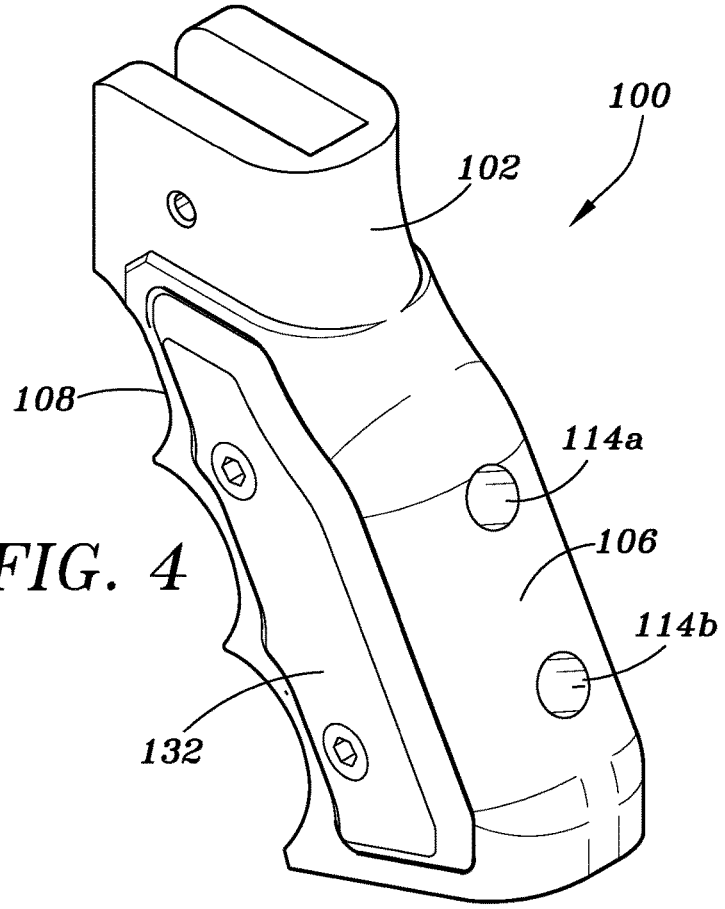
FIG. 4 depicts an assembled pistol grip assembly, as shown and described herein.
Figure 5:
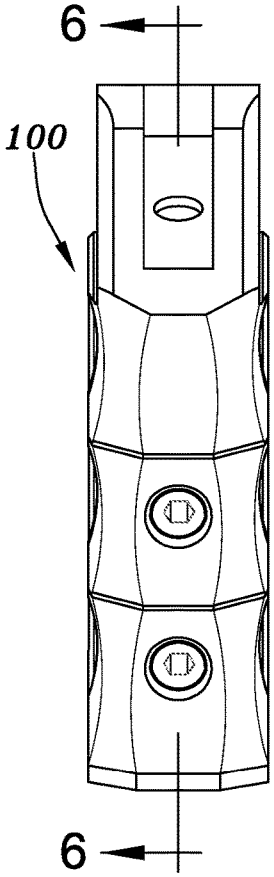
FIG. 5 depicts a front view of the handle having a frame disposed therein, as shown and described herein.
Figure 6:
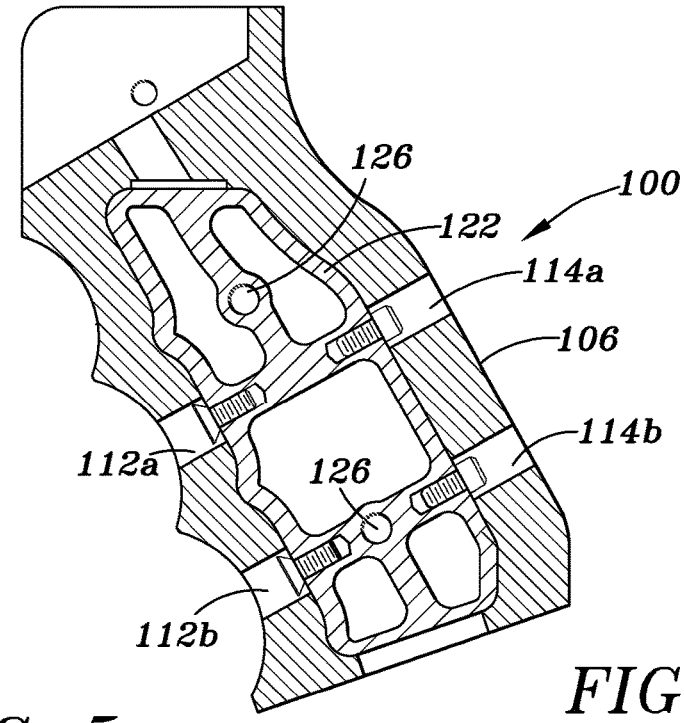
FIG. 6 depicts a cross-sectional side view of FIG. 5, as shown and described herein.

FIG. 4 depicts a left side view of an assembled pistol grip assembly 100, showing the left accessory seated in the handle cut-out 104. FIG. 5 depicts a front view of the handle 102 having the frame 122 disposed therein. FIG. 6 depicts a cross-sectional side view of FIG. 5. The pistol grip assembly 100 can be assembled by connecting the left and/or right accessories 132, 134 to the frame 122 by generally acceptable connection means. Similarly, the frame 122 can be secured to the handle 102 by generally acceptable connection means, including most notably, by one or more fasteners. As shown, a screw and corresponding threaded holes can be used as a fastener. Other fasteners and other attachment means can include magnets, bolts, glue, welding, or other suitable means.

In a preferred embodiment, the pistol grip assembly 100 can be manipulated and configured to fit the needs and/or wants of the user. Accordingly, the accessories 132, 134 are interchangeable and easily removable. The accessories 132, 134 can be shaped and sized to mirror one another, as shown in FIG. 1. In other embodiments, the left accessory 132 can have a different shape and/or size than the right accessory 134.

Referring to all Figures, a primary purpose of the disclosed pistol grip assembly 100 is to meet a user's preferences without requiring the user to obtain a completely new pistol grip. To accomplish this, the bodies of the left and right accessories 132, 134 can come in many varieties. A standard sized accessory 132, 134 is shown, but the accessory 132, 134 can be produced in one or several modified embodiments. "Modified," as used herein can include, for example, a variety or variation in shape, size, design, height, width, thickness, length, protrusion, etc. Most modifications take place at the manufacturing stage of production because the accessories are typically made of solid material not capable of modification thereafter.

To use the pistol grip assembly, a user should first select the left and/or right accessories he prefers. The user can then place the frame 122 into the cut-out 104 of the handle 102. The frame 122 can then be secured into place placing one or more screws through each of the rear through-holes 114*a-b* of the handle 102 and threading into the corresponding handle anchors 124. One or more screws can also be placed through each of the front through-holes 112*a-b* and into corresponding threaded handle anchors (See FIG. 6) about the front side of the frame 122.

The user can then place the left accessory 132 into the left side of the cut-out 104 of the handle 102 and place one or more screws through the through-holes provided in the accessory and into the threaded accessory anchor(s) 126 of the frame 122. Similarly, the user can place the right accessory 134 into the right side of the cut-out 104 of the handle 102 and place one or more screws through the through-holes provided in the accessory and into the threaded accessory anchor(s) 126 of the frame 122.

To exchange one or both accessories 132, 134 from the assembled pistol grip assembly 100, the user need only loosen and/or remove the fastener(s) holding the existing accessory in place, remove the accessory, position the new accessory within the cut-out 104, and attach the new accessory to the frame via the fastener(s).

In a first example, a user may have larger hands than normal, such that when he grips a standard sized pistol grip, his fingers overlap on the front side of the handle. This improper grip is both uncomfortable and can cause unstable and inaccurate shooting of the rifle. In the disclosed pistol grip assembly, the user can select left and right accessories that have a larger width so that the outer diameter of the assembled pistol grip assembly is larger and suitable for his larger hands.

In a second example, a user may be missing a finger on his firing hand. For example, the right-handed user may be missing his middle/third finger on his right hand. The lack of his middle finger may cause the user to hold the rifle insecurely, which could result in unstable and inaccurate shooting of the rifle. To alleviate the imbalance, the user can select a left accessory that is manipulated to have a missing finger replacement nodule. The finger replacement nodule can provide a surface for the user's fourth finger and second finger to abut. The finger replacement nodule now secures and balances the user's shooting hand to provide more accurate shooting.

In a third example, the user may wish to have a thumb nodule extending from the outer surface of an accessory. In this example, a right-handed shooter could elect a left accessory having a protrusion or nodule extending from the outside surface of the left accessory. The thumb rest nodule can have a variety of embodiments and is most commonly found at a position known to a person of skill in the art that is suitable for a thumb position.

In a fourth example, the user may wish to decrease the overall weight of the firearm. To accomplish this, the user can remove the left and right accessories from the pistol grip assembly. To reduce weight further, the user can remove the frame from the pistol grip assembly, thereby using only the handle connected to the lower receiver of the firearm.

In a fifth example, the user may wish to have one or two holes, loops, groves, or finger covers through which to place his fingers while griping the pistol grip assembly. In each situation, the user can select such an embodiment for the left and/or right assemblies. As mentioned, the assembly pieces can be customizable, and the left accessory can differ from the right accessory. In this way, the user can mold or shape the overall configuration of the pistol grip assembly to fit his needs and wishes. Such modifications can be made to provide comfort, ease of use, custom fitting, and color scheme and design to meet a user's desires, all while maintaining an operational gripping means.

Most pistol grip handles generally provide space (or length) so that the user's third fourth, and fifth fingers can comfortably wrap around and "hold" onto the handle. The handle depicted herein includes three finger rests 108 shown to be curved indentions in the front side of the handle 102. In some alternative embodiments, the front of the handle 102 can instead include a flat or textured surface with no obvious indentions to serve as finger rests. Notwithstanding the presence of the finger rests 108, the user's first finger (or "thumb") and second finger (or "pointer finger" or "trigger finger") are left without support and typically engage the outer surface of the upper portion 103 of the handle 102 when the user is holding and/or using the rifle. A need exists for an accessory configured to engage and provide security and support to the user's thumb and trigger fingers so that the user can more securely and more safely use the firearm. Two such accessories are disclosed below, and provide attachment options to accommodate a right-hand and/or left-hand shooter.

Figure 7:
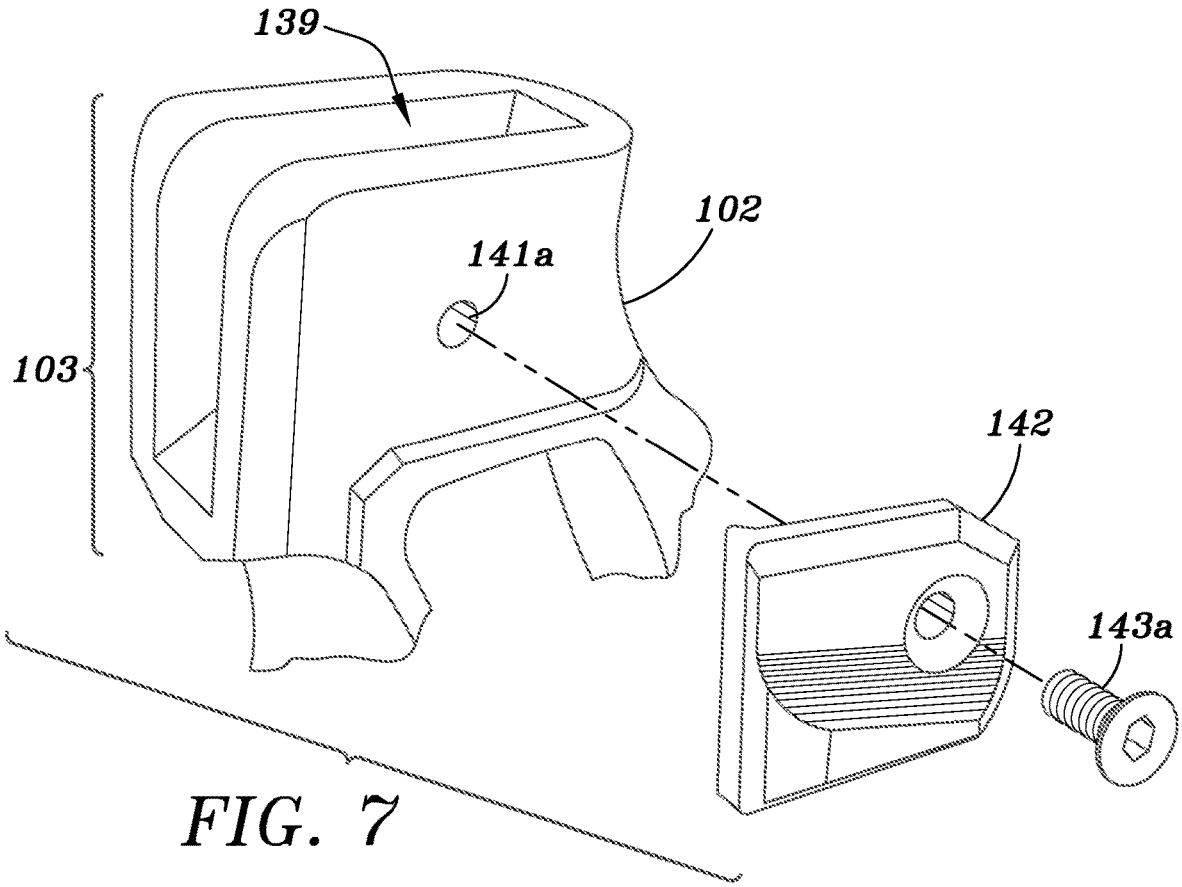
FIG. 7 depicts a close-up left side view of the top portion of the handle, as shown and described herein.
Figure 8:
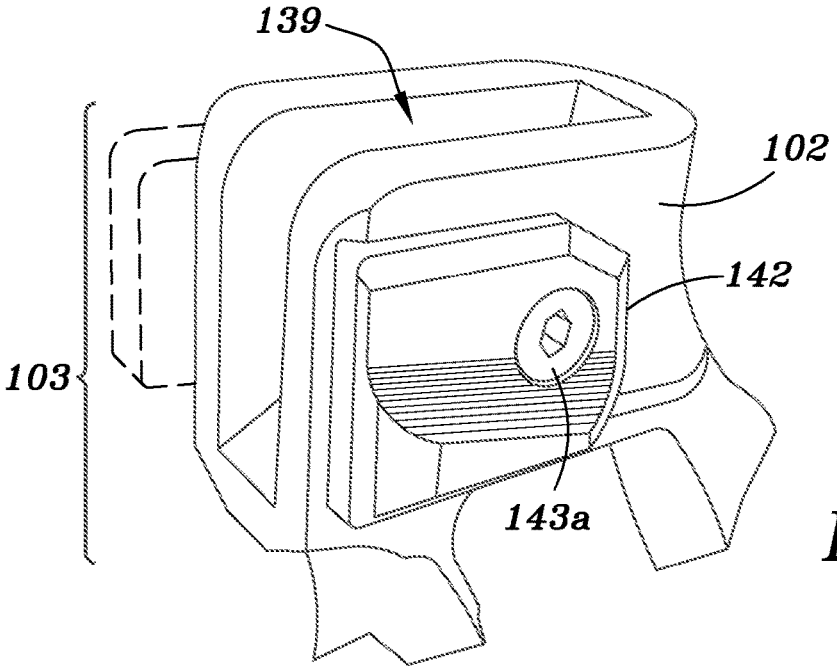
FIG. 8 depicts another close-up left side view of the top portion of the handle, as shown and described herein.

FIG. 7 depicts a close-up left side view of the top of the handle with an optional thumb rest and FIG. 8 depicts an assembled close-up left side view of the top of the handle. As shown, the disclosed handle and handle assembly can include a removable thumb rest accessory configured to attached to the top portion of the handle 102. This top portion 103 of the handle 102 is typically flat about a vertical plain and includes an internal slot 139 for attachment to a lower receiver of a firearm. The thumb rest accessory 142 can include a hole through which a connector 143*a* (most commonly a screw) can be disposed for connecting the thumb rest accessory 142 to a first side of this top portion of the handle 102.

The thumb rest accessory can come in variety of shapes and sizes. Similar to the accessories 132, 134 described above, the thumb rest accessory 142 can be configured or designed to accommodate the user's preferences and needs. As shown, the thumb rest accessory 142 can include a protrusion that includes graduated slope extending outward from the handle 102 such that a user's thumb can be disposed on the protrusion. In some embodiments, the protrusion can extend outward more than is shown, and in other embodiments the protrusion can extend outward less than is shown.

In a first alternative embodiment, the thumb rest accessory 142 can include a loop created by a strap or a hole in the thumb rest accessory 142 such that a user's thumb is completely encompassed by the thumb rest accessory 142. In a second alternative embodiment, the thumb rest 142 can include a notch, divot, and/or groove to engage the user's thumb.

Figure 9:
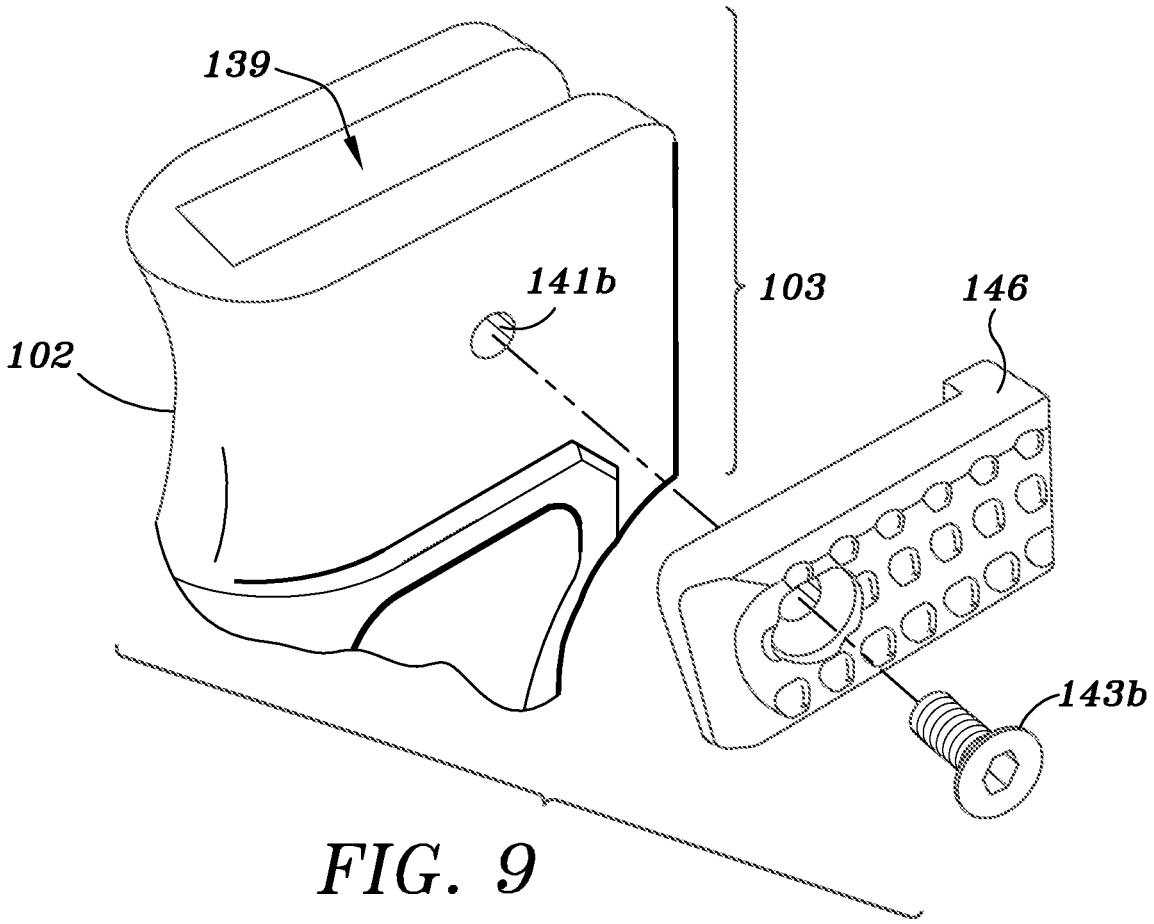
FIG. 9 depicts a close-up right side view of the top portion of the handle, as shown and described herein.
Figure 10:
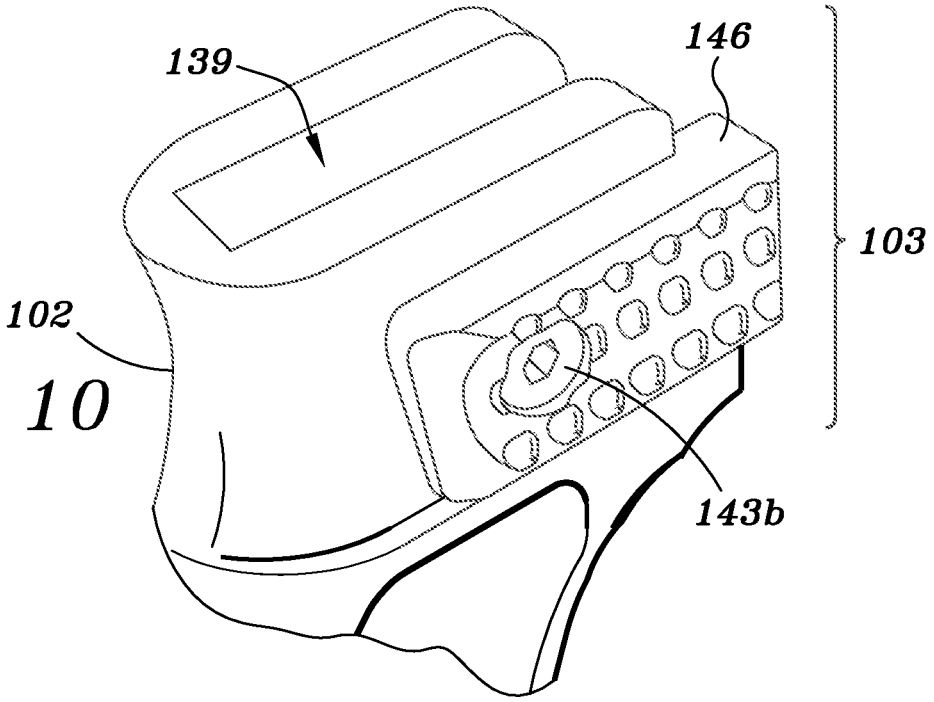
FIG. 10 depicts another close-up right side view of the top portion of the handle, as shown and described herein.

FIG. 9 depicts a close-up right side view of the top of the handle with an optional trigger finger rest accessory and FIG. 10 depicts an assembled close-up right side view of the top of the handle. As shown, the disclosed handle and handle assembly can include a removable trigger finger rest 146. The trigger finger rest 146 can also be removably attached to the top portion 103 of the handle 102 on the side of the user's trigger finger. The trigger finger rest 146 can include a hole or other attachment means through which a fastener 143*b* (most commonly a screw) can be disposed for connecting the trigger finger rest 146 to a second side of this top portion 103 of the handle 102. The user can engage the trigger finger rest 142 with his trigger finger.

Similar to the other accessories 132, 134, 142 described above, the trigger finger rest 146 can be configured or designed to accommodate the user's preferences and needs. As shown, the trigger finger rest 146 can include a textured surface having an indention extending along a horizontal plain and meant to align with the user's trigger finger while the user grips the handle 102. The trigger finger rest 146 can extends or protrude past the front of the handle 102 to any preferred distance, it is common for users not actively firing the rifle to rest their trigger finger alongside the lower receiver at a position above and away from the trigger so that the rifle is not inadvertently fired. This trigger finger rest 146 can be modified in shape and size to accommodate the trigger finger while in this position. The trigger rest can also be adapted to fit the size and shape of an individual's finger, providing several customizable options to fit the needs and preferences of firearm customers. The removable trigger finger rest 146 and thumb rest 142 can be disposed on either the left or right side of the handle, thereby accommodating a right- and/or left-handed shooter.

Although the present invention has been described with respect to specific details, it is not intended that such details be regarded as limitations on the scope of the invention, except to the extent that they are included in the accompanying claims. It will thus be appreciated that those skilled in the art will be able to devise numerous alternative arrangements that, while not shown or described herein, embody the principles of the invention and thus are within its spirit and scope.

I claim:

1. A pistol grip assembly, comprising:

a handle having a cut-out defining an internal anchoring space;

a first accessory positioned about the left side of the handle;

a second accessory positioned about the right side of the handle; and a frame removably disposed in the cut-out, the frame comprising multiple anchor sites for reception of the first accessory and the second accessory, respectively, wherein one or more fasteners secure the frame within the handle, and wherein the frame contacts the handle at a single periphery of the frame.

2. The pistol grip assembly of claim 1, wherein the first and second accessories are optionally removed from the pistol grip assembly and replaced with a respective third accessory and a fourth accessory.

3. The pistol grip assembly of claim 1, wherein the first accessory is removed and replaced with a third accessory and wherein the second accessory are removed and replaced with a fourth accessory.

4. The pistol grip assembly of claim 1, wherein one or more fasteners attach the first accessory to the left side of the frame and wherein one or more fasteners attach the second accessory to the right side of the frame.

5. The pistol grip assembly of claim 1, wherein the cut-out is of a size and shape so as to accommodate the frame.

* * * * *